US012497706B2

(12) United States Patent
Jung et al.

(10) Patent No.: US 12,497,706 B2
(45) Date of Patent: Dec. 16, 2025

(54) SOLUTION FOR ELECTROPLATING IRON, AND ELECTROPLATED STEEL SHEET MANUFACTURED BY USING SAME

(71) Applicant: POSCO Co., Ltd, Pohang-si (KR)

(72) Inventors: Jin-Ho Jung, Gwangyang-si (KR); Won-Hwi Lee, Gwangyang-si (KR); Sang-Bae Lim, Gwangyang-si (KR)

(73) Assignee: POSCO CO., LTD, Pohang-si (KR)

( * ) Notice: Subject to any disclaimer, the term of this patent is extended or adjusted under 35 U.S.C. 154(b) by 0 days.

(21) Appl. No.: 18/267,010

(22) PCT Filed: Dec. 14, 2020

(86) PCT No.: PCT/KR2020/018283
§ 371 (c)(1),
(2) Date: Jun. 13, 2023

(87) PCT Pub. No.: WO2022/131386
PCT Pub. Date: Jun. 23, 2022

(65) Prior Publication Data
US 2024/0044032 A1 Feb. 8, 2024

(51) Int. Cl.
*C25D 3/20* (2006.01)

(52) U.S. Cl.
CPC ..... *C25D 3/20* (2013.01)

(58) Field of Classification Search
None
See application file for complete search history.

(56) References Cited

U.S. PATENT DOCUMENTS

| | | | | |
|---|---|---|---|---|
| 3,871,973 | A | 3/1975 | Topham | |
| 4,101,387 | A | 7/1978 | Creutz et al. | |
| 5,849,423 | A | 12/1998 | Urakawa et al. | |
| 10,526,109 | B2 | 1/2020 | Taya et al. | |
| 2005/0189232 | A1* | 9/2005 | Fels | C25D 3/562 205/255 |
| 2022/0170164 | A1 | 6/2022 | Kohler et al. | |

FOREIGN PATENT DOCUMENTS

| | | | |
|---|---|---|---|
| CN | 1160090 | A | 9/1997 |
| DE | 102019108459 | A1 | 10/2020 |
| EP | 4261316 | A1 | 10/2023 |
| EP | 4261317 | A1 | 10/2023 |
| JP | S50-109138 | A | 8/1975 |
| JP | S53-093131 | A | 8/1978 |
| JP | S53-96933 | A | 8/1978 |
| JP | S54-051933 | A | 4/1979 |
| JP | S59-170299 | A | 9/1984 |
| JP | H03-223489 | A | 10/1991 |
| JP | H06-81188 | A | 3/1994 |
| JP | H07-207487 | A | 8/1995 |
| JP | H09-217192 | A | 8/1997 |
| JP | H10-204674 | A | 8/1998 |
| JP | 2005-256045 | A | 9/2005 |
| JP | 2007-525600 | A | 9/2007 |
| JP | 2009-079247 | A | 4/2009 |
| JP | 2013-245394 | A | 12/2013 |
| KR | 1997-0026596 | A | 6/1997 |
| KR | 10-2009-0112919 | A | 10/2009 |
| KR | 10-2013-0070235 | A | 6/2013 |
| KR | 10-1974066 | B1 | 8/2019 |
| KR | 10-2020-142748 | A | 12/2020 |

OTHER PUBLICATIONS

International Search Report dated Mar. 24, 2022, issued in International Patent Application No. PCT/KR2020/018283 (with English translation).
Extended European Search Report dated Jan. 3, 2024 issued in European Patent Application No. 20966040.6.
Japanese Office Action dated Jun. 18, 2024 issued in Japanese Patent Application No. 2023-536012 (with English translation).
Chinese Office Action dated Jun. 28, 2024 issued in Chinese Patent Application No. 202080107937.2 (with English translation).
Decision to Grant dated Oct. 22, 2024, issued in corresponding Japanese Patent Application No. 2023-536012.

* cited by examiner

*Primary Examiner* — Wojciech Haske
(74) *Attorney, Agent, or Firm* — Morgan Lewis & Bockius LLP

(57) ABSTRACT

The present invention relates to a solution for electroplating iron, comprising: iron ions comprising first iron ions and second iron ions; a complexing agent; and unavoidable impurities, wherein the amount of second iron ions among the iron ions is 5 to 60 wt %. According to the present invention, electroplating efficiency is high, there is no drop in electroplating efficiency due to a continuous plating operation, and sludge generation is prevented, and, thus, the plating solution is easily managed. Burning can be prevented even in a high current density operation, and, thus, a high-quality iron-plated layer can be achieved. The plating solution does not need to be replaced, as the concentration of second iron ions generated by a plating reaction is maintained to be constant, and, thus, the present invention is appropriate for a continuous plating process.

7 Claims, 3 Drawing Sheets

SOLUTION FOR ELECTROPLATING IRON, AND ELECTROPLATED STEEL SHEET MANUFACTURED BY USING SAME

CROSS-REFERENCE OF RELATED APPLICATIONS

This application is the U.S. National Phase under 35 U.S.C. § 371 of International Patent Application No. PCT/KR2020/018283, filed on Dec. 14, 2021, the disclosure of which the application is incorporated by reference herein.

TECHNICAL FIELD

The present disclosure relates to an iron electroplating solution and an electroplated steel sheet manufactured using the same, and in particular, to an iron electroplating solution having excellent electroplating efficiency and coating adhesion and prevents formation of sludge even when electroplating is performed at a high current density for a long period of time, and an electroplated steel sheet manufactured using the same.

BACKGROUND ART

A steel sheet has been widely used as a structural material for an automobile, a home appliance, a building material, or the like because it has excellent mechanical strength, excellent workability, and abundant resources, but since the steel sheet itself has extremely poor corrosion resistance, lifespan thereof is extended mainly by subjecting a surface thereof to a surface treatment such as plating.

In particular, iron is a substance manufactured into a steel sheet or a steel material and used as a general-purpose structural material, but corrosion resistance and appearance properties thereof are inferior to those of other metals. Therefore, electroplating has been performed to utilize magnetic properties or to form a special-purpose alloy. However, iron has extremely low plating efficiency in the electroplating process and has a problem in that sludge is formed during long-term use, and thus it is significantly difficult to apply iron industrially.

For example, Patent Document 1 discloses an iron plating solution for a base of an electro-galvanized steel sheet. In Patent Document 1, a complexing agent such as gluconic acid, nitrilotriacetic acid (NTA), ethylenediaminetetraacetic acid (EDTA), or citric acid is used to prevent sludge, and in this case, although it is possible to prevent sludge, overvoltage is increased, plating efficiency is low, and burning occurs, and as a result, a plated layer is easily detached. In addition, since thiourea, imidazole, and the like are easily electrolyzed during electroplating, it is significantly difficult to manage the solution and control the concentration in a continuous process.

Also, in Patent Documents 2, 3, and 4, a carboxylic acid such as gluconic acid, tartaric acid, citric acid, or dicarboxylic acid may be used as a complexing agent to prevent sludge. However, when an operation is performed at a high current density, plating efficiency is low, and burning occurs, and as a result, a plated layer is easily detached. Meanwhile, in a case in which ascorbic acid is used, since ascorbic acid serves to reduce ferric ions to ferrous ions, it is possible to temporarily prevent sludge, but when ascorbic acid is oxidized and dehydroascorbic acid is produced, dehydroascorbic acid is complexed with iron ions, and thus electroplating efficiency is rapidly reduced, which is not suitable for a continuous operation.

Meanwhile, a conventional iron plating solution contains ferrous ions ($Fe^{2+}$), but the ferrous ions are oxidized to ferric ions ($Fe^{3+}$) in a continuous electroplating process, plating efficiency is rapidly reduced, and sludge is formed. Therefore, the ferric ions should be reduced to ferrous ions or the solution should be replaced periodically, which is difficult to apply in a large-scale continuous electroplating process. In addition, a method of suppressing formation of ferric ions in a solution by using a soluble anode has been proposed, but since the soluble anode is gradually dissolved and consumed as plating is performed, a distance between electrodes and surface condition change, and the solution should be replaced periodically, resulting in difficulties of management.

RELATED ART DOCUMENT

Patent Document

Korean Patent Laid-Open Publication No. 10-2009-0112919
Korean Patent Laid-Open Publication No. 10-2013-0070235
Japanese Patent Laid-Open Publication No. 1998-204674
Japanese Patent Laid-Open Publication No. 1994-081188

DISCLOSURE

Technical Problem

The present disclosure has been devised in view of the above circumstances, an object of the present disclosure is to provide an iron electroplating solution that may suppress formation of sludge due to oxidation of iron ions even when a continuous plating is performed for a long period of time, may keep plating efficiency constant, and does not require frequent solution replacement, and an electroplated steel sheet manufactured using the same.

Technical Solution

According to an aspect of the present disclosure, an iron electroplating solution contains iron ions including ferrous ions and ferric ions; a complexing agent; and unavoidable impurities, wherein a content of the ferric ions in the iron ions is 5 to 60 wt %.

A concentration of the iron ions may be 1 to 80 g per 1 liter of the iron electroplating solution.

A molar concentration ratio of the iron ions to the complexing agent may be 1:0.05 to 2.0.

The complexing agent may be one or more selected from an amino acid and an amino acid polymer.

The complexing agent may be one or more selected from alanine, glycine, serine, threonine, arginine, glutamine, glutamic acid, and glycylglycine.

A pH of the iron electroplating solution may be 1.2 to 4.0.

The iron electroplating solution may further contain a conductive auxiliary agent in an amount of 200 g or less per 1 liter of the iron electroplating solution.

The conductive auxiliary agent may be one or more selected from sodium sulfate, potassium sulfate, and ammonium sulfate.

According to another aspect of the present disclosure, there is provided a steel sheet plated with iron using the iron electroplating solution.

Advantageous Effects

According to the present disclosure, electroplating efficiency is high, a reduction in electroplating efficiency due to a continuous plating operation does not occur, and formation of sludge is prevented, such that the plating solution is easily managed.

Further, burning may be prevented even in an operation at a high current density, such that a high-quality iron-plated layer may be obtained.

Further, as a concentration of ferric ions generated by a plating reaction is maintained to be constant, the plating solution does not need to be replaced, and thus the plating solution is suitable for a continuous plating process.

BEST MODE FOR INVENTION

Figure 1:
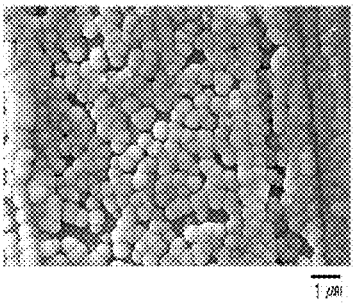
FIG. 1 is a photograph of a specimen at the initial stage captured by scanning electron microscope, the specimen being plated using a plating solution of Example 3 at a current density of 50 $A/dm^2$ for 0.7 seconds.

Hereinafter, preferred exemplary embodiments in the present disclosure will be described with reference to various exemplary embodiments. However, exemplary embodiments in the present disclosure may be modified in several other forms, and the scope of the present disclosure is not limited to exemplary embodiments to be described below.

The present disclosure relates to an iron electroplating solution and an electroplated steel sheet manufactured using the same, and in particular, to an iron electroplating solution having excellent electroplating efficiency and coating adhesion and prevents formation of sludge even when electroplating is performed at a high current density for a long period of time, and an electroplated steel sheet manufactured using the same.

Electroplating has been used as a method of forming a uniform and pure iron-plated layer in a continuous plating process. However, iron may exist in a form of ferrous ions ($Fe^{2+}$), which are divalent ions, and ferric ions ($Fe^{3+}$), which are trivalent ions, and the ferric ions easily form sludge even in an acidic solution with a pH of 2 or higher.

Even when only ferrous ions, which do not form sludge, are used as a raw material to prepare an electrolyte, ferric ions are naturally formed in the solution when they come into contact with oxygen in the air or oxygen generated in the electroplating process. In addition, when an insoluble anode is used, ferrous ions are directly oxidized to ferric ions by an oxidation reaction of the anode. When a soluble anode is used to suppress formation of ferric ions, oxidation of iron ions may be somewhat suppressed, but oxidation of iron ions cannot be fundamentally suppressed. Therefore, when ferric iron is formed, a filtration device for removing sludge is essential, and since the electrolyte should be periodically replaced to remove ferric ions to be accumulated, which inevitably causes extreme waste of raw materials.

When the pH of the solution is managed to be 2 or lower, the formation of sludge may be somewhat suppressed, but a hydrogen reduction reaction increases, such that the electroplating efficiency is rapidly reduced, and the formation of ferric ions cannot be fundamentally suppressed.

Meanwhile, a complexing agent is added to suppress the formation of sludge in the iron electroplating solution. In the present disclosure, the complexing agent refers to a substance that strongly binds to metal ions in an aqueous solution to form complex ions, which inhibits binding of hydroxyl ions (OH) in water to metal ions to prevent the formation of sludge. Therefore, when binding between the complexing agent and the metal ions is weaker than the binding force between the hydroxyl ions and the metal ions, the complexing agent does not play a role in preventing sludge. On the other hand, when the binding between the complexing agent and the metal ions is excessively strong, the formation of sludge may be prevented, but it is difficult to separate the complexing agent and the metal ions during the plating process, which increases plating overvoltage, thereby reducing the plating efficiency.

In order to prevent sludge in the solution, a case using a chelating molecule as an effective organic complexing agent may be considered. Representative chelates include oxalic acid and citric acid containing two or more carboxyl groups in one molecule, and also include NTA and EDTA containing a plurality of carboxyl groups and amines. A complexing agent containing a plurality of carboxyl groups may inhibit binding of the iron ions to the hydroxyl ions and thus may suppress formation of sludge because two or more carboxyl groups in one molecule of the complexing agent form strong bonds with the iron ions, but it is difficult to separate the iron ions and molecules of the complexing agent during the plating process at a cathode. Therefore, as described above, the reduction in plating efficiency due to an increase in plating overvoltage occurs.

Meanwhile, the carboxyl group forms a negative charge as hydrogen is dissociated in weak acidity, a complexing agent containing two or more carboxyl groups forms monovalent or divalent or higher anions in a pH range of 2 to 4, and complex ions formed by binding of the complexing agent to the iron ions also have a negative charge. When the complex ions have a negative charge, an electrical repulsive force against the cathode where the electroplating reaction occurs is generated, such that it is difficult to transfer substances, and the plating efficiency is reduced. On the other hand, at the anode where the oxidation reaction occurs, transfer of substances is further facilitated by anionic complex ions, which further increases ferric ions. In particular, since ferric ions have a much stronger binding force with the complexing agent than ferrous ions, ferric ions generated in the solution do not form sludge, but are not used in the plating reaction at all and are accumulated. Therefore, when plating is performed for a long period of time in a continuous process, as only the concentration of ferrous ions participating in the plating reaction rapidly decreases, but the concentration of ferric ions increases, a desired coating weight cannot be obtained due to a reduction in plating efficiency, and the plating quality is deteriorated due to occurrence of burning, such that the solution should be replaced periodically, which causes extreme waste of raw materials.

Through studies to solve the above problems, the present inventors found have that, when an iron electroplating solution contains a certain amount of ferric ions, formation of ferric ions due to oxidation of ferrous ions is suppressed at the anode, the reaction in which ferric ions are reduced to ferrous ions is accelerated at the cathode, and ferric ions may thus be used as an iron electroplating raw material, the plating efficiency may be stably secured even when the solution is used for a long period of time because the state of the solution in a continuous electroplating process does not change significantly due to small changes in pH and concentration of ferric iron, and when an amino acid or an amino acid polymer is used as a complexing agent in an electrolyte for iron electroplating, high plating efficiency may be obtained while suppressing formation of sludge due to ferric iron formation, thereby completing the present disclosure.

That is, according to a preferred exemplary embodiment in the present disclosure, it is possible to suppress formation of sludge by oxidation of ferrous iron to ferric iron, and at the same time, it is possible to suppress deterioration of the solution by reusing ferric ions as an iron electroplating raw material, thereby keeping plating efficiency constant.

According to an aspect of the present disclosure, there is provided an iron electroplating solution containing: iron ions including ferrous ions and ferric ions; a complexing agent; and unavoidable impurities, wherein a content of the ferric ions in the iron ions is 5 to 60 wt %. In the present disclosure, the unavoidable impurities refer to, for example, alloying elements such as manganese and silicon eluted from a base steel sheet or elements contained in solution raw materials.

According to a preferred exemplary embodiment in the present disclosure, the iron electroplating solution contains ferrous ions and ferric ions. In order to obtain high plating efficiency, it may be advantageous to contain only ferrous ions. However, when only ferrous ions are contained, the solution is deteriorated and the plating efficiency is rapidly reduced, which is not preferable because quality deviation is caused in a continuous electroplating process.

Therefore, in the present disclosure, a content of the ferric ions in the iron ions is preferably 5 to 60 wt %, and more preferably 5 to 40 wt %. When the content of the ferric ions is less than 5%, as a rate at which ferric iron is reduced to ferrous iron at the cathode is smaller than a rate at which ferrous iron is oxidized to ferric iron at the anode, a concentration of the ferric iron rapidly increases and the pH rapidly decreases, resulting in a continuous reduction in plating efficiency. On the other hand, when the concentration of the ferric ions exceeds 60%, as the amount of reaction in which ferric iron is reduced to ferrous iron at the cathode is greater than the amount of reaction in which ferrous iron is reduced and precipitated as metallic iron, the plating efficiency is reduced, resulting in deterioration of the plating quality. Therefore, it is preferable that the content of the ferric ions in the iron ions is set to be 5 to 60 wt % in consideration of equipment and process characteristics such as a coating weight, an operation current density, a solution replenishment amount, the amount of solution lost on a strip, and a concentration change rate due to evaporation.

Meanwhile, in order to prepare a solution containing ferrous ions, a method of dissolving pure metallic iron, iron oxide, or iron hydroxide in high-concentration sulfuric acid, a method of mixing and dissolving ferrous sulfate and ferric sulfate, and the like may be used, but the present disclosure is not limited to the above raw materials and methods.

In addition, in order to prepare an iron electroplating solution containing ferric ions, a sulfuric acid-based plating solution (electrolyte) containing ferric iron may be prepared by mixing and dissolving sulfate, iron oxide, iron hydroxide, and the like containing ferric iron, or preparing a sulfuric acid-based electrolyte containing only ferrous iron, and then oxidizing the sulfuric acid-based electrolyte by adding an oxidizing agent such as hydrogen peroxide or injecting air, or electrically oxidizing the sulfuric acid-based electrolyte by applying anode voltage, but the preparation method is not limited thereto.

A concentration of the iron ions is preferably 1 to 80 g per 1 liter of the iron electroplating solution, and more preferably 10 to 50 g per 1 liter of the iron electroplating solution. When the concentration of the iron ions is less than 1 g/L, the plating efficiency and the plating quality are rapidly reduced, and on the other hand, when the concentration of the iron ions exceeds 80 g/L, as the solubility exceeds, precipitation may occur, and the loss of the raw materials due to a loss of the solution increases in the continuous plating process, which is not economical.

The iron electroplating solution of the present disclosure contains a complexing agent, and it is preferable to use an amino acid or an amino acid polymer as the complexing agent in order to prevent formation of sludge and maintain high plating efficiency even when a large amount of ferric iron is contained.

An amino acid refers to an organic molecule in which a carboxyl group (—COOH) and an amine group (—$NH_2$) are bonded, an amino acid polymer refers to an organic molecule formed by polymerization of two or more amino acids, and the amino acid polymer exhibits complexing agent properties similar to those of the amino acid. Therefore, in the following description, the amino acid and the amino acid polymer are collectively referred to as an amino acid.

When the amino acid is dissolved in neutral water, amines are combined with hydrogen ions to have a positive charge, and carboxyl groups have a negative charge because hydrogen ions are dissociated. Therefore, amino acid molecules maintain charge neutrality. When the solution is acidified, as the carboxyl groups are recombined with hydrogen ions to become charge neutral and the amines have a positive charge, the amino acid molecules form cations. That is, the amino acid forms charge neutral ions or cations in a slightly acidic aqueous solution.

When an amino acid is added to an acidic electrolyte containing iron ions, the amino acid is complexed with ferrous ions and ferric ions, and the iron ions complexed with the amino acid maintain a cation state even in a complexed state. Therefore, a typical complexing agent containing a plurality of carboxyl groups exhibits characteristics electrically opposite to those of a complexing agent having a negative charge in a weakly acidic aqueous solution.

In addition, compared to a complexing agent containing a plurality of carboxyl groups such as citric acid and EDTA, an amino acid forms fewer bonds with iron ions and has a weak binding force, but has a strong binding force with ferric ions that cause formation of sludge, such that precipitation by ferric ions may be prevented. In addition, since cations may be maintained even when ferric ions are complexed, ferric ions are easily transferred to the cathode and are reduced to ferrous ions to participate in the plating reaction. On the other hand, since movement to the anode is suppressed and a production rate of ferric ions is slowed down, the concentration of the ferric ions may be maintained at a certain level even when a continuous plating is performed for a long period of time, the plating efficiency is maintained to be constant, and therefore, there is no need to replace the electrolyte.

Meanwhile, in the continuous electroplating process, when the iron ions in the solution are consumed by plating, the solution is acidified. Even when iron ions are precipitated in the same amount, a change in pH of the solution also containing ferric ions is reduced compared to that of the solution containing only ferrous ions. When the pH increases, some ferric ions bind to hydroxyl ions, and when the pH decreases, hydroxyl ions are separated and neutralized. Therefore, a solution containing ferric ions acts as a pH buffer because the change in pH is slowed down even without an additional pH buffer, that the electroplating efficiency may be maintained to be constant in the continuous electroplating process.

Therefore, sludge may be prevented using an amino acid as a complexing agent, ferric ions as well as ferrous ions may be used as plating raw materials, and when ferrous ions and ferric ions are mixed and used, the change in pH is slowed down, and accumulation of the ferric ions may be easily prevented, such that the electroplating efficiency and the plating quality may be maintained to be constant.

Meanwhile, the complexing agent is preferably added in an amount in which a molar concentration ratio of the iron ions to the complexing agent is 1:0.05 to 2.0, and is more preferably added in an amount in which a molar concentration ratio of the iron ions to the complexing agent is 1:0.5 to 1.0. When the molar concentration ratio is less than 0.05, formation of sludge caused by binding of ferric ions contained in excess to hydroxyl ions or oxygen is not suppressed, the plating efficiency is significantly reduced even when ferric iron is not contained, and furthermore, burning occurs, resulting in deterioration of the plating quality. On the other hand, even when the molar concentration ratio exceeds 2.0, the sludge suppression effect and the plating quality are maintained, but the plating efficiency is reduced due to an increase in overvoltage, such that the amino acid, which is relatively expensive compared to raw materials containing iron ions, such as iron sulfate, is unnecessarily excessively contained, and raw material costs increase, which is not economical.

The complexing agent is preferably one or more selected from an amino acid and an amino acid polymer, and may be, for example, one or more selected from alanine, glycine, serine, threonine, arginine, glutamine, glutamic acid, and glycylglycine.

According to an exemplary embodiment in the present disclosure, a pH of the iron electroplating solution is preferably 1.2 to 6.0 and more preferably 2 to 4. When the pH is lower than 1.2, the reduction reaction of hydrogen ions increases rapidly and the electroplating efficiency is rapidly reduced, and on the other hand, when the pH exceeds 6, ferrous ions also form sludge, and thus, it is difficult to keep the solution clean even when a large amount of complexing agent is contained. Meanwhile, when the pH is 4 to 6, although the solution itself may be kept clean while electroplating is not performed, sludge may be temporarily formed and the solution may become turbid during plating by applying electricity. Therefore, in order to keep the plating efficiency high while preventing formation of sludge, it is more preferably to control the pH to 2 to 4. Meanwhile, an acid and alkali solution including sulfuric acid, sodium hydroxide, potassium hydroxide, ammonia, and the like may be used for the pH control, but the present disclosure is not limited thereto.

According to an exemplary embodiment in the present disclosure, the iron electroplating solution may further contain a conductive auxiliary agent in an amount of 200 g of less per 1 liter of the iron electroplating solution (but, excluding 0), as necessary. For example, in a case where the concentration of iron ions is low, the pH is high, and an operation at a high current is required, the plating voltage may be reduced using the conductive auxiliary agent. However, when the amount of the conductive auxiliary agent exceeds 200 g/L, the conductivity does not increase significantly and the specific gravity of the solution increases, which is disadvantageous for solution circulation, and precipitation may occur at a low temperature. Therefore, it is preferable to use the conductive auxiliary agent in an amount of 200 g or less per 1 liter of the iron electroplating solution.

The type of conductive auxiliary agent is not specifically limited, but for example, at least one selected from sodium sulfate, potassium sulfate, and ammonium sulfate may be used.

Meanwhile, according to another aspect of the present disclosure, there is provided a steel sheet plated with iron using the iron electroplating solution. Preferably, when electroplating is performed using the iron electroplating solution at a temperature of 80° C. or lower and a current density of 0.5 to 150 A/dm$^2$, high electroplating efficiency may be maintained without formation of sludge, and it is possible to obtain an iron-plated steel sheet in which a high-quality iron-plated layer is formed.

Hereinafter, the present disclosure will be described in more detail with reference to specific Examples. The following Examples are only examples provided in order to assist in the understanding of the present disclosure, but the scope of the present disclosure is not limited thereto.

MODE FOR INVENTION

Examples

Ferrous sulfate and ferric sulfate were used to prepare an iron plating solution. One type of amino acid was selected as a complexing agent, and the complexing agent was dissolved to obtain a concentration by calculating the weight based on a molar concentration ratio according to a concentration of iron ions.

The pH of the solution was controlled using sulfuric acid or sodium hydroxide. As for the solution preparation order, a complexing agent, a conductive auxiliary agent, and the like were first dissolved in pure water, and then iron sulfate was added. When iron sulfate is dissolved first, sludge is formed during the dissolution process, and even when the complexing agent is added thereafter, the sludge is not well dissolved. Therefore, iron sulfate is preferably added after the complexing agent is completely dissolved.

When a solution with a pH of 4 or higher was prepared, the solution was neutralized with sodium hydroxide, and precipitates temporarily generated during this process were completely dissolved by stirring for a sufficient time. The prepared plating solution was heated to 50° C.

A copper sheet and a cold-rolled steel sheet were used as base metals. A surface of the base metal was cleaned with alcohol, and the base metal was degreased under normal alkali degreasing conditions, immersed in a 1 to 5% sulfuric acid solution for about 10 seconds, pickled, washed with pure water, and then plated.

An insoluble metal plate coated with $IrO_2$ was used as an anode, and an area to be plated was set to be the same as that of the anode plate. The results of plating obtained from the respective prepared plating solutions are shown in Table 1.

Meanwhile, considering that the iron plating solution of the present disclosure was designed to be used for a long period of time in a continuous process, as well as the plating efficiency and formation of sludge immediately after solution preparation, in order to determine the electroplating efficiency and formation of sludge when the solution was modified, such as when a certain amount of iron ions was consumed in a continuous process and the pH was lowered, and when a significant amount of ferrous ions was oxidized to ferric iron, after each solution was prepared, plating was performed in a total of three steps.

Specifically, in step 1, each solution was prepared and heated, a rectifier was connected to the base metal and the anode plate, and then a current density and a plating time were controlled, thereby preparing a plated specimen in the initial plating solution. A copper sheet and a cold-rolled steel sheet were used as base metals, the plating efficiency was measured from the results of plating on the copper sheet, and coating adhesion was evaluated from the results of plating on the cold-rolled steel sheet. In order to measure the electroplating efficiency, the specimen plated on the copper sheet, which was a plated layer, was dissolved in a hydrochloric acid solution, the total amount of iron in the solution was measured to calculate a coating weight, and the calculated coating weight was expressed as the initial plating efficiency.

In step 2, in order to confirm the change in properties of the solution when electroplating was performed using the above solution for a long period of time, the total amount of current at which 10% of the total amount of iron ions contained in the plating solution was precipitated was calculated, the current was continuously applied, and the base metal was replaced periodically, as necessary.

In step 3, a plated specimen was prepared in the same manner as in step 1 using a modified solution by applying a current for a long period of time, and plating quality and final plating efficiency were measured.

The surface shape of the iron-plated layer obtained by using the cold-rolled steel sheet as a base metal was analyzed using a scanning electron microscope, and detachment of the plated layer was visually observed using a tape on the surface of the plated specimen. The level of adhesion of the plated layer is shown in Table 1, and the evaluation criteria are as follows.

- o: Level at which no powder detached was visually observed at all
- Δ: Level at which the plated layer was detached in the powder form and was visually observed
- x: Level at which the plated layer was peeled off or a large amount of the plated layer was detached in the powder form

TABLE 1

| | Electrolyte composition | | | | | | | | | | | |
|---|---|---|---|---|---|---|---|---|---|---|---|---|
| Classification | Iron ion concentration (g/L) | Ferric ratio (%) | Complexing agent | Iron: complexing agent molar concentration ratio | pH | Conductive auxiliary agent | pH buffer | Current density (A/dm$^2$) | Coating adhesion | Plating efficiency(%) Initial stage | Plating efficiency(%) Final stage | Formation of sludge |
| Comparative Example 1 | 0.1 | 10 | Glutamine | 1:0.5 | 3~4 | — | — | 10 | Δ | 5~10 | 5~10 | X |
| Example 1 | 1 | | | | | — | — | 20 | ○ | 25~30 | 20~25 | X |
| Example 2 | 10 | 20 | | 1:0.5 | 2~3 | — | — | 50 | ○ | 50~55 | 40~45 | X |
| Example 3 | 25 | | | | | — | — | 50 | ○ | 75~80 | 70~75 | X |
| Example 4 | 80 | | | | | — | — | 50 | ○ | 80~85 | 70~75 | X |
| Comparative Example 2 | 25 | <1 | Glutamine | 1:0.5 | 2~3 | — | — | 50 | ○ | 80~85 | 45~50 | X |
| Example 5 | | 5 | | | | — | — | 50 | ○ | 80~85 | 60~65 | X |
| Example 6 | | 40 | | | | — | — | 50 | ○ | 70~75 | 60~65 | X |
| Example 7 | | 60 | | | | — | — | 50 | ○ | 60~65 | 60~65 | X |
| Comparative Example 3 | | 80 | | | | — | — | 50 | X | 30~35 | 40~45 | X |
| Comparative Example 4 | 25 | 20 | Glutamine | 1:0.01 | 2~3 | — | — | 50 | X | 20~25 | 5~10 | ○ |
| Example 8 | | | | 1:0.05 | | — | — | 50 | ○ | 70~75 | 50~55 | X |
| Example 9 | | | | 1:0.2 | | — | — | 50 | ○ | 80~85 | 70~75 | X |
| Example 10 | | | | 1:1.0 | | — | — | 50 | ○ | 60~65 | 60~65 | X |
| Example 11 | | | | 1:2.0 | | — | — | 50 | ○ | 55~60 | 50~55 | X |
| Example 12 | 25 | 20 | Glycylglycine | 1:0.05 | 2~3 | — | — | 50 | ○ | 5~10 | 5~10 | X |
| Example 13 | | | | 1:0.2 | | — | — | 50 | ○ | 40~45 | 35~40 | X |
| Example 14 | | | | 1:0.5 | | — | — | 50 | ○ | 80~85 | 60~65 | X |
| Example 15 | | | | 1:1.0 | | — | — | 50 | ○ | 30~35 | 10~15 | X |
| Example 16 | | | | 1:2.0 | | — | — | 50 | ○ | 40~45 | 40~45 | X |
| Comparative Example 5 | 25 | 20 | Glutamine | 1:0.5 | 1~1.2 | — | — | 50 | X | 50~55 | 45~50 | X |
| Example 17 | | | | | 1.2~2.0 | — | — | 50 | ○ | 70~75 | 60~65 | X |
| Example 18 | | | | | 3~4 | — | — | 50 | ○ | 80~85 | 70~75 | X |
| Comparative Example 6 | | | | | 5~6 | — | — | 50 | X | 60~65 | 50~55 | ○ |
| Example 19 | 25 | 20 | Glutamine | 1:0.5 | 2~3 | — | — | 0.5 | ○ | 60~65 | 55~60 | X |
| Example 20 | | | | | | — | — | 2 | ○ | 75~80 | 60~65 | X |
| Example 21 | | | | | | — | — | 10 | ○ | 75~80 | 70~75 | X |
| Example 22 | | | | | | — | — | 100 | ○ | 65~70 | 60~65 | X |
| Example 23 | | | | | | — | — | 150 | ○ | 60~65 | 55~60 | X |
| Example 24 | 25 | 20 | Alanine | 1:0.5 | 2~3 | — | — | 50 | ○ | 65~70 | 55~60 | X |
| Comparative Example 7 | | | Citric acid | 1:0.5 | 2~3 | — | — | 50 | X | 15~20 | <5 | X |
| Comparative Example 8 | | | Gluconic acid | | | — | — | 50 | X | 30~35 | 15~20 | X |

TABLE 1-continued

| Classification | Electrolyte composition: Iron ion concentration (g/L) | Ferric ratio (%) | Complexing agent | Iron: complexing agent molar concentration ratio | pH | Conductive auxiliary agent | pH buffer | Current density (A/dm$^2$) | Coating adhesion | Plating efficiency(%): Initial stage | Plating efficiency(%): Final stage | Formation of sludge |
|---|---|---|---|---|---|---|---|---|---|---|---|---|
| Example 25 | 25 | 20 | Glutamine | 1:0.5 | 2~3 | Sodium sulfate 50 g/L | — | 50 | ○ | 75~80 | 70~75 | X |
| Example 26 | | | | | | Sodium sulfate 50 g/L | Citric acid 3 g/L | 50 | ○ | 70~75 | 65~70 | X |
| Comparative Example 9 | | | | | | Sodium sulfate 50 g/L | Citric acid 50 g/L | 50 | X | 20~25 | 5~10 | X |

Examples 1 to 4 and Comparative Example 1 show the results according to the concentration of the iron ions using glutamine, one of amino acids, as a complexing agent. The plating was performed by setting the concentration of glutamine to be 0.5 times the concentration of the iron ions in terms of molar concentration ratio, controlling the pH to be 2 to 4, and setting the plating current density to be 10 to 50 A/dm$^2$ according to the concentration of the iron ions in the solution. As described in Examples 1 to 4, when the concentration of the iron ions was 1 g/L or more, the coating adhesion was excellent, sludge formed due to long-term use was not observed, and the plating efficiency tended to increase as the iron concentration increased. However, as in Comparative Example 1, when the concentration of the iron ions was too low, the plating efficiency was low due to a low limiting current density of the iron plating reaction, and a large amount of hydroxide was mixed in the plated layer to form a black plated layer, and adhesion was deteriorated.

Figure 2:
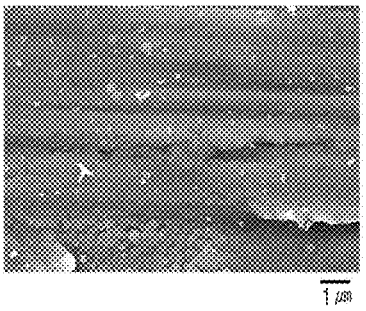
FIG. 2 is a photograph of the specimen at the final stage taken by the scanning electron microscope, the specimen being plated using the plating solution of Example 3 at a current density of 50 $A/dm^2$ for 0.7 seconds.

FIG. 1 illustrates a photograph of a specimen at the initial stage captured by scanning electron microscope, the specimen being plated using the plating solution of Example 3 at a current density of 50 A/dm$^2$ for 0.7 seconds. Iron began to grow in the form of spherical iron metal particles at the initial stage of electroplating. FIG. 2 illustrates a photograph of the specimen at the final stage captured by scanning electron microscope. As the plating time was increased, the plating structure became dense, and when plating was performed for 2.0 seconds or longer, a dense plated layer was formed as illustrated in FIG. 2.

Referring to the results of Examples 5 to 7 and Comparative Examples 2 and 3, the initial plating efficiency tended to be gradually reduced as the ratio of the ferric ions to the total iron ions increased. However, as the ratio of the ferric ions increased, the plating efficiency rather increased when the solution was modified by applying an amount of current capable of plating 10% of the total amount of iron ions. In particular, as in Comparative Example 2, when ferric iron was contained in the initial solution in an amount of less than 5%, the plating efficiency was rather rapidly reduced in a solution used for a long period of time, and thus it was difficult to keep the plating efficiency constant during a continuous process. On the other hand, when the concentration of the ferric ions exceeded 60%, although the plating efficiency was slightly increased in the modified solution compared to the initial solution, the plating efficiency was low in both the initial solution and the final solution, and the plated layer was easily detached, resulting in deterioration of plating quality.

In Examples 8 to 11 and Comparative Example 4, glutamine was used as a complexing agent, and the plating efficiency and the formation of sludge according to the content of the complexing agent were shown. As in Comparative Example 4, when the concentration of the complexing agent was 0.01 or less relative to the molar concentration of iron, the plating efficiency was low, sludge was easily formed during plating, and it was difficult to perform stable electroplating, such as detachment of the plated layer, but when the concentration of the complexing agent was 0.05 or more relative to the molar concentration of iron, the plating efficiency was high, and sludge was not formed.

In Examples 12 to 16, glycylglycine, one of amino acid polymers, was used as a complexing agent, and the results of measuring the plating efficiency were shown. The plating efficiency was excellent in both the initial solution and the sufficiently modified solution, and no sludge was formed.

The pH of each of the iron electroplating solutions of Examples 17 and 18 and Comparative Examples 5 and 6 was controlled to 1 to 6, and then electroplating was performed. As in Comparative Example 5, the iron electroplating solution with a pH of lower than 1.2 was significantly stable, and cleanliness of the solution was maintained, but the plating efficiency was too low. However, when the pH was 1.2 or higher, the plating efficiency gradually increased as the pH increased. When the pH exceeded 4, the cleanliness of the solution was maintained during non-plating, but a small amount of precipitates was generated during a continuous plating process, and most of the precipitates were dissolved when stirred. However, when the pH exceeded 5, the precipitates generated during the plating process were not naturally redissolved even when stirred, the plated layer was easily detached, and the plating efficiency was rather reduced.

In order for the electroplating solution to be industrially applicable, it is required to adjust the current density as necessary, and thus a wider current density range in which an operation may be performed is preferable. In Examples 19 to 23, the plating efficiency was measured by varying the current density from 0.5 to 150 A/dm$^2$. As the current density was lower, the plating efficiency tended to be reduced because hydrogen generation and side reactions in which ferric ions were reduced to ferrous ions relatively increased compared to the current consumed for plating. Meanwhile, the plating efficiency increased significantly as the current density increased up to 100 A/dm$^2$, and when the current density was increased to 150 A/dm$^2$, the plating efficiency was slightly reduced, but the plating quality was excellent while still maintaining high plating efficiency, and no sludge was formed.

In Example 24, alanine, one of amino acids, was used as a complexing agent, and in Comparative Examples 7 and 8, electroplating was performed using a solution prepared using citric acid and gluconic acid containing only carboxyl groups in the molecule as a complexing agent. In the solution using alanine, plating efficiencies at the initial and final stages similar to those in the case of using glutamine, one of amino acids, or glycylglycine, one of amino acid polymers, as a complexing agent, were obtained, and no sludge was formed during the plating process. However, when citric acid and gluconic acid were used as a complexing agent, although no sludge was formed, the initial plating efficiency was significantly low, the plated layer was easily detached, and excellent plating quality could not be obtained, in particular, in the solution used for a long period of time, the plating efficiency was rapidly reduced.

Figure 3:
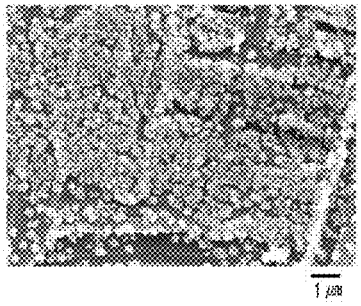
FIG. 3 is a photograph of a specimen plated using a plating solution of Comparative Example 7 captured by scanning electron microscope.

FIG. 3 illustrates a photograph of the specimen plated using the solution of Comparative Example 7 using citric acid as a complexing agent observed with a scanning electron microscope. Unlike the plating structures of FIGS. 1 and 2 obtained using glutamine as a complexing agent, in the case of the plating structure obtained using the iron plating solution containing citric acid, the specimen was plated with significantly fine and coarse particles, and a significantly large amount of hydroxide was contained in the plated layer.

From the above results, it may be appreciated that, unlike the plating solution using a carboxylic acid complexing agent, which is a commonly used complexing agent, the solution containing an amino acid or an amino acid polymer as a complexing agent prevents incorporation of hydroxides and suppresses burning to obtain a high-quality plated layer, has high electroplating efficiency, maintains plating efficiency even after long-term use, and suppresses formation of sludge, and thus it is expected that a high-speed continuous operation will be possible.

Although exemplary embodiments in the present disclosure have been described in detail above, it will be apparent to those skilled in the art that the scope of the present disclosure is not limited thereto, but modifications and variations could be made without departing from the technical idea of the present disclosure described in the claims.

The invention claimed is:

1. An iron electroplating solution comprising:

iron ions including ferrous ions and ferric ions;

a complexing agent that is one or more selected from an amino acid and an amino acid polymer; and unavoidable impurities, wherein a pH of the iron electroplating solution is 1.2 to 4.0, wherein a content of the ferric ions in the iron ions is 5 to 60 wt %, and wherein a molar concentration ratio of the iron ions to the complexing agent is 1:0.05 to 2.0.

2. The iron electroplating solution of claim 1, wherein a concentration of the iron ions is 1 to 80 g per liter of the iron electroplating solution.

3. The iron electroplating solution of claim 1, wherein the complexing agent is one or more selected from alanine, glycine, serine, threonine, arginine, glutamine, glutamic acid, and glycylglycine.

4. The iron electroplating solution of claim 1, further comprising a conductive auxiliary agent in an amount of 200 g or less (excluding 0) per liter of the iron electroplating solution.

5. The iron electroplating solution of claim 4, wherein the conductive auxiliary agent is one or more selected from sodium sulfate, potassium sulfate, and ammonium sulfate.

6. The iron electroplating solution of claim 5, wherein a concentration of the iron ions is 1 to 80 g per liter of the iron electroplating solution, wherein the complexing agent is one or more selected from alanine, glycine, serine, threonine, arginine, glutamine, glutamic acid, and glycylglycine, and wherein the molar concentration ratio of the iron ions to the complexing agent is 1:0.5 to 1.0.

7. The iron electroplating solution of claim 1, wherein the molar concentration ratio of the iron ions to the complexing agent is 1:0.5 to 1.0.

* * * * *